US005537134A

United States Patent [19]

Baldwin et al.

[11] Patent Number: 5,537,134

[45] Date of Patent: Jul. 16, 1996

[54] REFILL METHOD FOR INK-JET PRINT CARTRIDGE

[75] Inventors: Marc A. Baldwin; Bruce Cowger; Joseph R. Elliot; Lowell R. McDaniel, all of Corvallis, Oreg.

[73] Assignee: Hewlett-Packard Company, Palo Alto, Calif.

[21] Appl. No.: 85,708

[22] Filed: Jun. 30, 1993

Related U.S. Application Data

[63] Continuation-in-part of Ser. No. 957,534, Oct. 5, 1992, and Ser. No. 805,438, Dec. 11, 1991, Pat. No. 5,409,134, which is a continuation-in-part of Ser. No. 464,258, Jan. 12, 1990, abandoned.

[51] Int. Cl.[6] ..... B41J 2/175

[52] U.S. Cl. ..... 347/85

[58] Field of Search ..... 347/85, 86, 87; 141/2, 10, 18, 20.5, 113; 401/222

[56] References Cited

U.S. PATENT DOCUMENTS

| | | | |
|---|---|---|---|
| 1,794,651 | 3/1931 | Spayde | 401/222 |
| 3,296,624 | 1/1967 | Ascoli | 347/85 |
| 3,452,361 | 6/1969 | Williams, Jr. | 347/85 |
| 4,121,222 | 10/1978 | Diebold et al. | 347/85 |
| 4,149,172 | 4/1979 | Heinzl et la. | 347/85 |
| 4,207,012 | 6/1980 | Kuparinen | 401/258 |
| 4,217,058 | 8/1980 | Straszewski et al. | 401/135 |
| 4,263,602 | 4/1981 | Matsumoto et al. | 347/85 |
| 4,272,773 | 6/1981 | Halasz | 347/85 |
| 4,342,042 | 7/1982 | Cruz Uribe et al. | 347/86 |
| 4,382,707 | 5/1983 | Anderka | 401/198 |
| 4,412,232 | 10/1983 | Weber et al. | 347/87 |
| 4,419,678 | 12/1983 | Kasugayama | 347/86 |
| 4,422,084 | 12/1983 | Saito | 347/85 |
| 4,436,439 | 3/1984 | Koto | 400/126 |
| 4,490,728 | 12/1984 | Vaught et al. | 347/11 |
| 4,496,959 | 1/1985 | Frerichs | 347/85 |
| 4,500,895 | 2/1985 | Buck et al. | 347/87 |
| 4,509,062 | 4/1985 | Low et al. | 347/85 |
| 4,539,568 | 9/1985 | Lewis | 347/86 |
| 4,571,599 | 2/1986 | Rezanka | 347/87 |
| 4,671,692 | 6/1987 | Inaba | 407/199 |
| 4,673,955 | 6/1987 | Ameyama et al. | 347/86 |
| 4,677,447 | 6/1987 | Nielsen | 347/85 |
| 4,714,937 | 12/1987 | Kaplinsky | 347/87 |
| 4,771,295 | 9/1988 | Baker et al. | 347/87 |
| 4,777,497 | 10/1988 | Nozu et al. | 347/86 |
| 4,785,314 | 11/1988 | Terasawa et al. | 347/86 |
| 4,791,438 | 12/1988 | Hanson et al. | 347/87 |
| 4,794,409 | 12/1988 | Cowger et al. | 347/87 |
| 4,905,019 | 2/1990 | Vonasek | 347/85 |
| 5,039,999 | 8/1991 | Winslow et al. | 347/86 |
| 5,040,001 | 8/1991 | Dunn et al. | 347/87 |
| 5,040,002 | 8/1991 | Pollacek et al. | 347/87 |
| 5,153,612 | 10/1992 | Dunn et al. | 347/87 |
| 5,329,294 | 7/1994 | Ontawar et al. | 347/87 |
| 5,409,134 | 4/1995 | Cowger et al. | 347/87 X |

FOREIGN PATENT DOCUMENTS

| | | | |
|---|---|---|---|
| 0375388 | 6/1990 | European Pat. Off. . | |
| 2742633 | 4/1979 | Germany . | |
| 56-92072 | 7/1981 | Japan . | |
| 59-232872 | 12/1984 | Japan . | |
| 02003310 | 3/1990 | Japan | B41J 2/175 |
| 2063715 | 6/1981 | United Kingdom . | |
| WO9411194 | 5/1994 | WIPO | B41J 2/175 |
| WO9411195 | 5/1994 | WIPO | B41J 2/175 |

OTHER PUBLICATIONS

Robert C. Durbeck et al., (*Output Hardcopy Devices,* Academic Press 1988) Chapter 13, "Ink Jet Printing" by William J. Lloyd et al.

*Hewlett–Packard Journal,* vol. 36, No. 5, (May 1985), pp. 1–27.

European Search Report, Sep. 26, 1991, 4 pages, regarding EP 89313319.9.

*Primary Examiner*—Benjamin R. Fuller
*Assistant Examiner*—Alrick Bobb

[57] ABSTRACT

The ink-jet print cartridge, which has an internal accumulator for maintaining appropriate back pressure within the pen reservoir, and a bubble generator for providing additional regulation, is refilled by a process that provides for the reestablishment of the necessary back pressure upon refilling and that prevents leakage arising as a result of the refilling operation.

9 Claims, 7 Drawing Sheets

REFILL METHOD FOR INK-JET PRINT CARTRIDGE

This is a continuation-in-part of U.S. patent application Ser. No. 07/805,438, filed Dec. 11, 1991, U.S. Pat. No. 5,409,134, which is a continuation-in-part of U.S. patent application Ser. No. 07/464,258, filed Jan. 12, 1990, now abandoned. This is also a continuation-in-part of U.S. patent application No. Ser. No. 07/957,534, filed Oct. 5, 1992.

TECHNICAL FIELD

The present invention is directed to a method of refilling the reservoir of an ink-jet print cartridge.

BACKGROUND INFORMATION

Ink-jet printing generally involves the controlled delivery of ink drops from an ink-jet print cartridge reservoir to a printing surface. One type of ink-jet printing, known as drop-on-demand printing, employs a print cartridge or pen that has a print head that is responsive to control signals for ejecting drops of ink from an associated ink reservoir.

One type of drop-on-demand print head uses a thermal bubble mechanism for ejecting drops. A thermal bubble type print head includes a thin-film resistor that is heated to cause sudden vaporization of a small portion of the ink. The rapid expansion of the ink vapor forces a small amount of ink through an associated one of a number of nozzles in the print head.

Conventional drop-on-demand print heads are effective for ejecting or "pumping" ink drops from a pen reservoir, but require mechanisms for preventing ink from leaking through the print head nozzles when the print head is inactive. Accordingly, drop-on-demand techniques require that the fluid in the ink reservoir must be stored in a manner that provides a slight back pressure at the print head to prevent ink leakage from the pen whenever the print head is inactive. As used herein, the term "back pressure" means the partial vacuum within the pen reservoir that resists the flow of ink through the print head. Back pressure is considered in the positive sense so that an increase in back pressure represents an increase in the partial vacuum. Accordingly, back pressure is measured in positive terms, such as water column height.

The back pressure at the print head must be at all times strong enough for preventing ink leakage. The back pressure, however, must not be so strong that the print head is unable to overcome the back pressure to eject ink drops. Moreover, the ink-jet pen must be designed to operate despite environmental changes that cause fluctuations in the back pressure.

A severe environmental change that affects reservoir back pressure occurs during air transport of an ink-jet pen. In this instance, ambient atmosphere pressure decreases as the aircraft gains altitude and is depressurized. As ambient air pressure decreases, a correspondingly greater amount of back pressure is needed to keep ink from leaking through the print head. Accordingly, the level of back pressure within the pen must be regulated during times of ambient pressure drop.

The back pressure within an ink-jet pen reservoir is also subjected to what may be termed "operational effects." One significant operational effect occurs as the print head is activated to eject ink drops. The consequent depletion of ink from the reservoir increases (makes more negative) the reservoir back pressure. Without regulation of this back pressure increase, the ink-jet pen will eventually fail because the print head will be unable to overcome the increased back pressure to eject ink drops.

Past efforts to regulate ink-jet reservoir back pressure in response to environmental changes and operational effects have included mechanisms that may be collectively referred to as accumulators.

Described in U.S. patent application Ser. No. 07/805,438, U.S. Pat. No. 5,409,134, which application is owned by the assignee of the present application, is a pressure-sensitive accumulator for ink-jet pens. The accumulator described in that application provides an accumulator working volume that is sufficient for operating the pen notwithstanding extreme environmental changes and operational effects on the back pressure within the reservoir. The accumulator moves to change the overall volume of the reservoir, thereby to regulate back pressure level changes so that the back pressure remains within an operating range that is suitable for preventing ink leakage while permitting the print head to continue ejecting ink drops.

For example, as the difference between ambient pressure and the back pressure within the pen decreases as a result of ambient air pressure drop, the accumulator moves to increase the reservoir volume, thereby to increase the back pressure to a level, within the range discussed above, that prevents ink leakage. Put another way, the increased volume attributable to accumulator movement prevents a decrease in the difference between ambient air pressure and back pressure that would otherwise occur if the reservoir were constrained to a fixed volume as ambient air pressure decreased.

The accumulator also moves to decrease the reservoir volume whenever environmental changes or operational effects (for example, ink depletion occurring during operation of the pen) cause an increase in the back pressure. The decreased reservoir volume attributable to accumulator movement reduces the back pressure to a level within the operating range, thereby permitting the print head to continue ejecting ink.

Accumulators are usually equipped with internal or external resilient mechanisms that continuously urge the accumulators toward a position for increasing the volume of the reservoir. The effect of the resilient mechanisms is to retain a sufficient minimum back pressure within the reservoir (to prevent ink leakage) even as the accumulator moves to increase or decrease the reservoir volume.

Even with a large-working-volume accumulator as just mentioned, there may be instances where the accumulator reaches its maximum working volume (for example, to reduce the back pressure within the reservoir as most of the ink is depleted during printing) while an appreciable amount of ink remains in the reservoir. Continued printing to remove this remaining amount of ink could increase the back pressure (which can no longer be regulated inasmuch as the accumulator has reached its maximum working volume) by a level outside of the operating range, which increase would cause the problem of print head failure owing to too high a back pressure level.

To avoid this problem, some ink-jet pens incorporate a "bubble generator." A bubble generator is an orifice formed in the ink reservoir to allow fluid communication between the interior of the reservoir and the ambient atmosphere. The orifice is sized such that the capillarity of the ink normally retains a small quantity of ink in the orifice as a liquid seal. The geometry of the orifice is such that when the back pressure approaches the limit of the operating range of the print head, the back pressure overcomes the capillarity of the ink and the liquid seal is broken. Ambient air then "bubbles" into the reservoir to reduce the back pressure so that the print head can continue to operate. Ideally, when the back pressure drops, ink from the reservoir reenters the orifice and reinstates the liquid seal.

In the past, ink-jet pens of the type just described were usually disposed of once the reservoir was depleted.

SUMMARY OF THE INVENTION

The present invention is directed to a method for refilling the ink reservoir of an ink-jet pen that includes an accumulator of the type described above. The method is also extendible to pens that include such an accumulator in combination with a bubble generator as mentioned above.

The method may be employed for substantially replacing all the depleted ink in the reservoir or for replacing only a portion of the depleted ink. The method allows the continued use of the same pen body and print head, so that only reservoir ink is replaced, instead of the entire pen.

The present method permits the refilling of the pen reservoir while maintaining or reestablishing a minimum back pressure within the refilled reservoir for the proper operation of the pen.

BRIEF DESCRIPTION OF THE DRAWINGS

FIG. 7 1s a sectional view, similar to FIG. 5, and illustrating certain steps of the method of the present invention.

DESCRIPTION OF A PREFERRED EMBODIMENT

Figure 1:
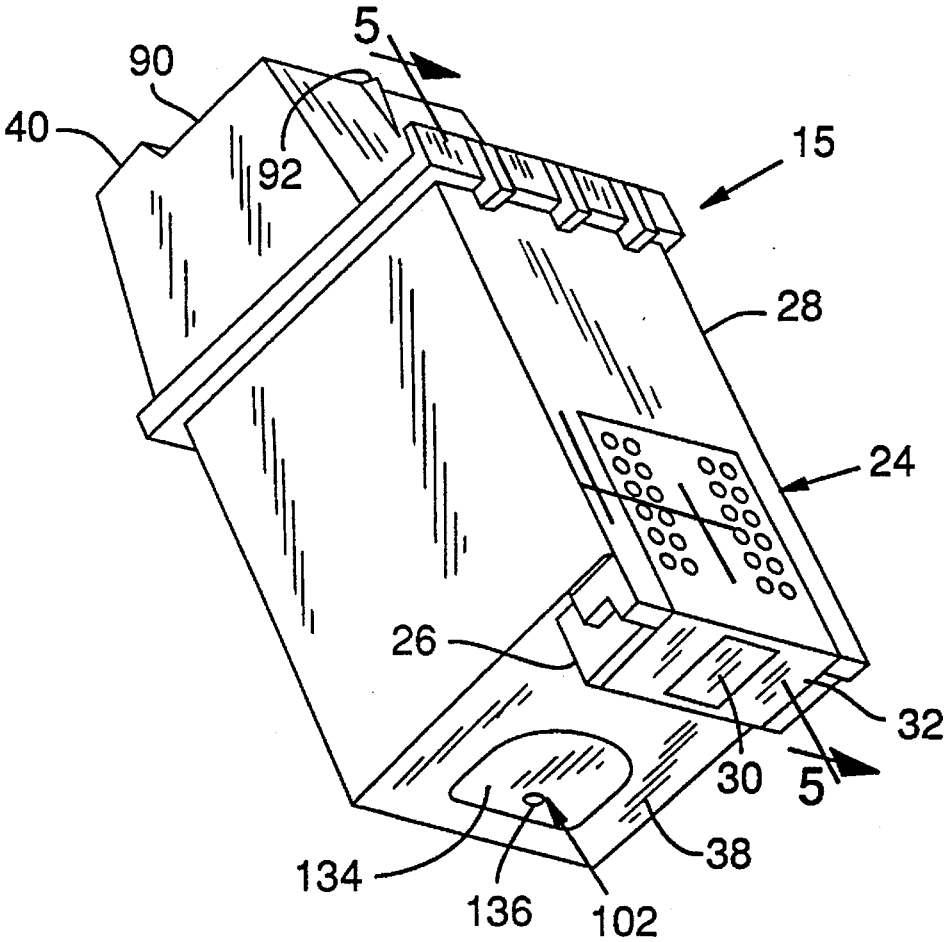
FIG. 1 is a perspective view of an ink-jet pen to which the method of the present invention may be applied.
Figure 2:
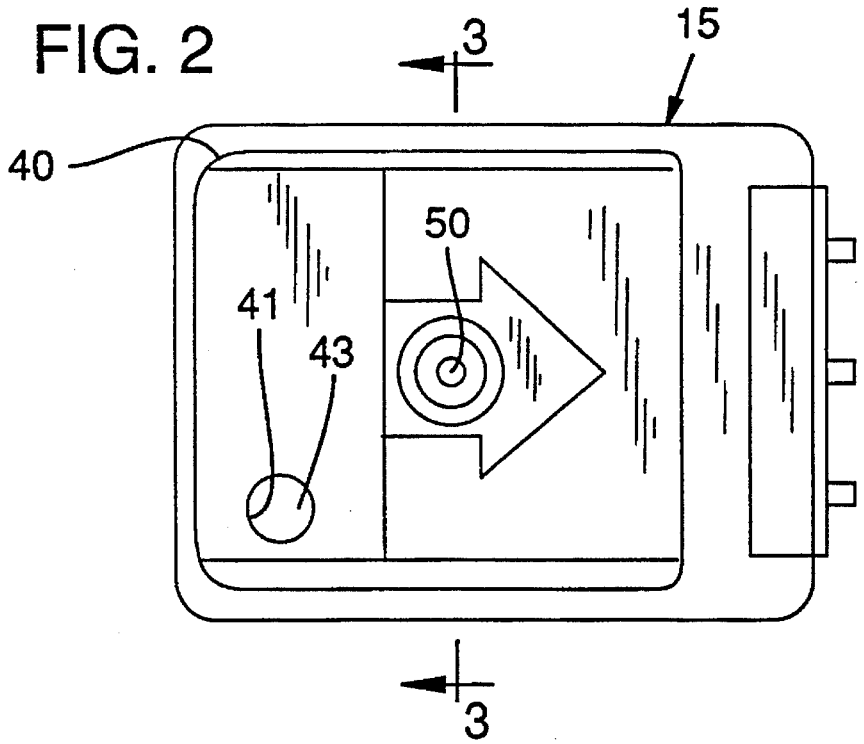
FIG. 2 is a top plan view of the pen of FIG. 1.
Figure 3:
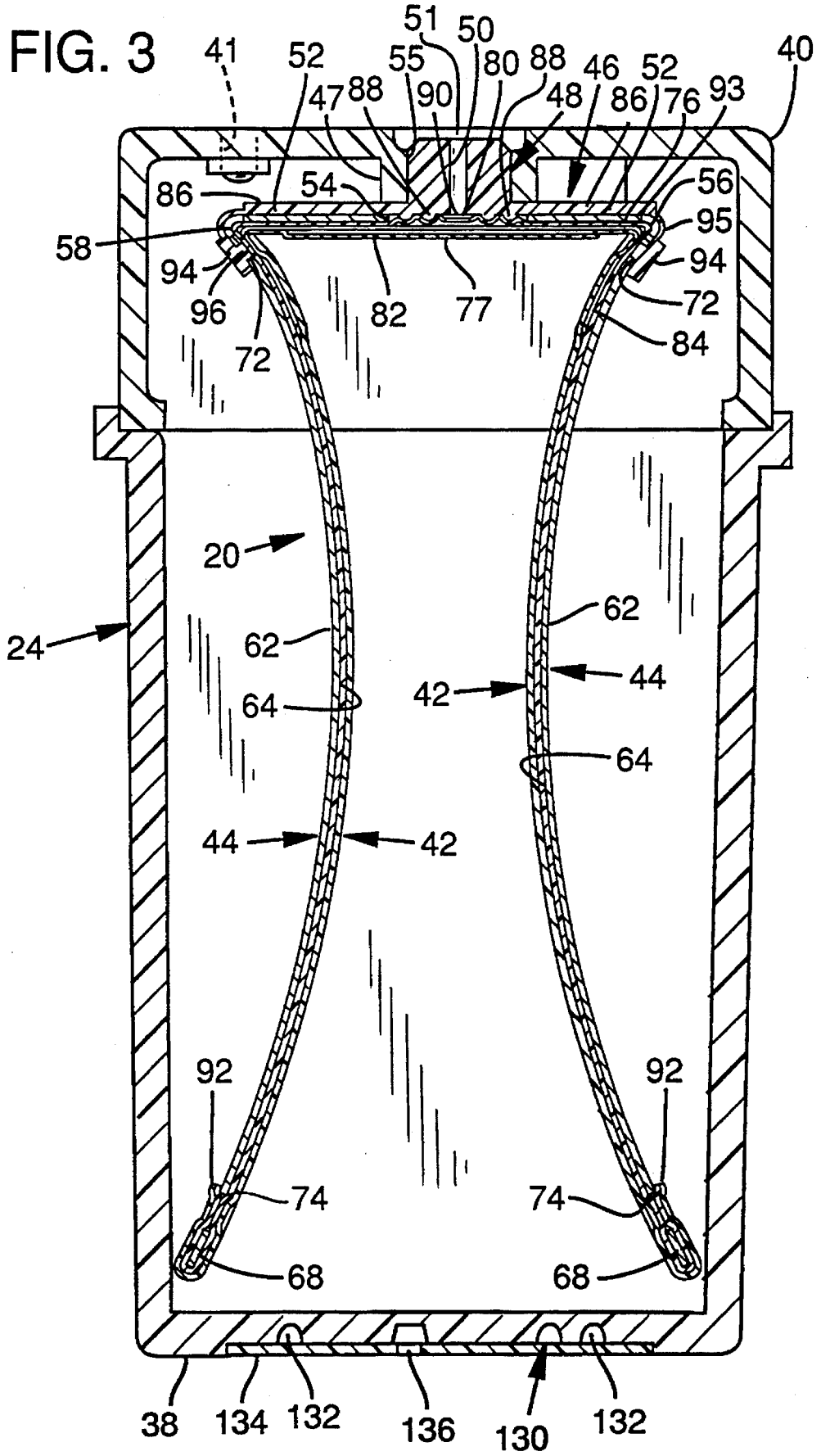
FIG. 3 is a cross-sectional view taken along line 3—3 of FIG. 2.

FIGS. 1–3 show a preferred embodiment of an ink-jet pen 15 to which the refill method of the present invention is applicable. It will be understood that the term "print cartridge" or "pen" may be interchangeably used in this specification. The pen 15 includes an internal accumulator to provide compensation for severe environmental changes or operational effects on the back pressure within the ink-jet pen reservoir.

The pen includes a reservoir 24 having rigid side walls that are configured to hold a quantity of ink. A well 26 is formed in the bottom of the reservoir 24 near one side wall 28 of the pen. A thermal-bubble type print head 30 is fit into the bottom wall 32 of the reservoir well 26 for ejecting ink drops through nozzles 29 in the print head. The configuration of the reservoir walls and print head may be substantially as provided in the pen component of an ink-jet printer manufactured by Hewlett-Packard Company of Palo Alto, Calif., under the trademark DeskJet.

An accumulator 20 (FIG. 3) is attached to a cap 40 that is sealed to the top of the side walls of the reservoir 24. The accumulator 20 includes an expandable bag 42 that is mounted to a spring 44. The bag 42 and spring 44 are fastened to a fitment 46 that has an upwardly projecting boss 48. The boss 48 is sealed to a cylindrically shaped sleeve 47 that is integrally formed with the top of the cap 40.

The bag 42 is fastened to the fitment 46 so that the interior of the bag is in fluid communication with the lower end of a central duct 50 that passes through the boss 48. The fitment 46 is mounted to the cap 40 of the pen 15 with the duct 50 arranged so that the upper end 51 of the duct is in fluid communication with ambient air. Accordingly, the interior of the bag 42 is in fluid communication with ambient air.

With the accumulator 20 in place, the reservoir 24 is filled with ink through a sealable port 41. Preferably, a spherical, resilient air-impermeable plug 43 is pressed into the port 41 after ink is added, thereby sealing or closing the reservoir to permit establishment of the back pressure within the reservoir. A slight back pressure (hereinafter referred to as the minimum back pressure) is established within the pen reservoir 24. The minimum back pressure is the minimum amount of back pressure necessary to keep ink from leaking through the print head 30 when the print head is inactive.

As the pen 15 is used for printing, the air pressure within the reservoir 24 decreases (hence, the back pressure increases) as ink is depleted. During printing, the bag 42 expands (FIG. 6) as a result of the back pressure increase. The bag expansion decreases the volume of the reservoir 24 to maintain the reservoir back pressure within a range such that the print head 30 is able to continue ejecting ink from the reservoir 24. If the ambient pressure should thereafter decrease (for example, during air transport of the pen), the bag 42 will contract to increase the reservoir volume so that the back pressure within the reservoir 24, relative to ambient, does not drop to a level that permits ink to leak from the print head 30.

Expansion of the bag 42 deflects the spring 44. The elasticity of the spring 44 tends to contract the bag 42. The spring 44 and bag 42 are configured and arranged to define a back pressure and bag volume relationship that maintains the reservoir back pressure within an operating range that is suitable for preventing ink leakage, while permitting the print head 30 to continue ejecting ink drops. Moreover, the accumulator 20 is configured so that the maximum volume of the bag 42, that is, the working volume of the accumulator, is large enough to maintain the reservoir back pressure within the operating range mentioned above, despite severe fluctuations in the pressure of the ambient air.

Figure 5:
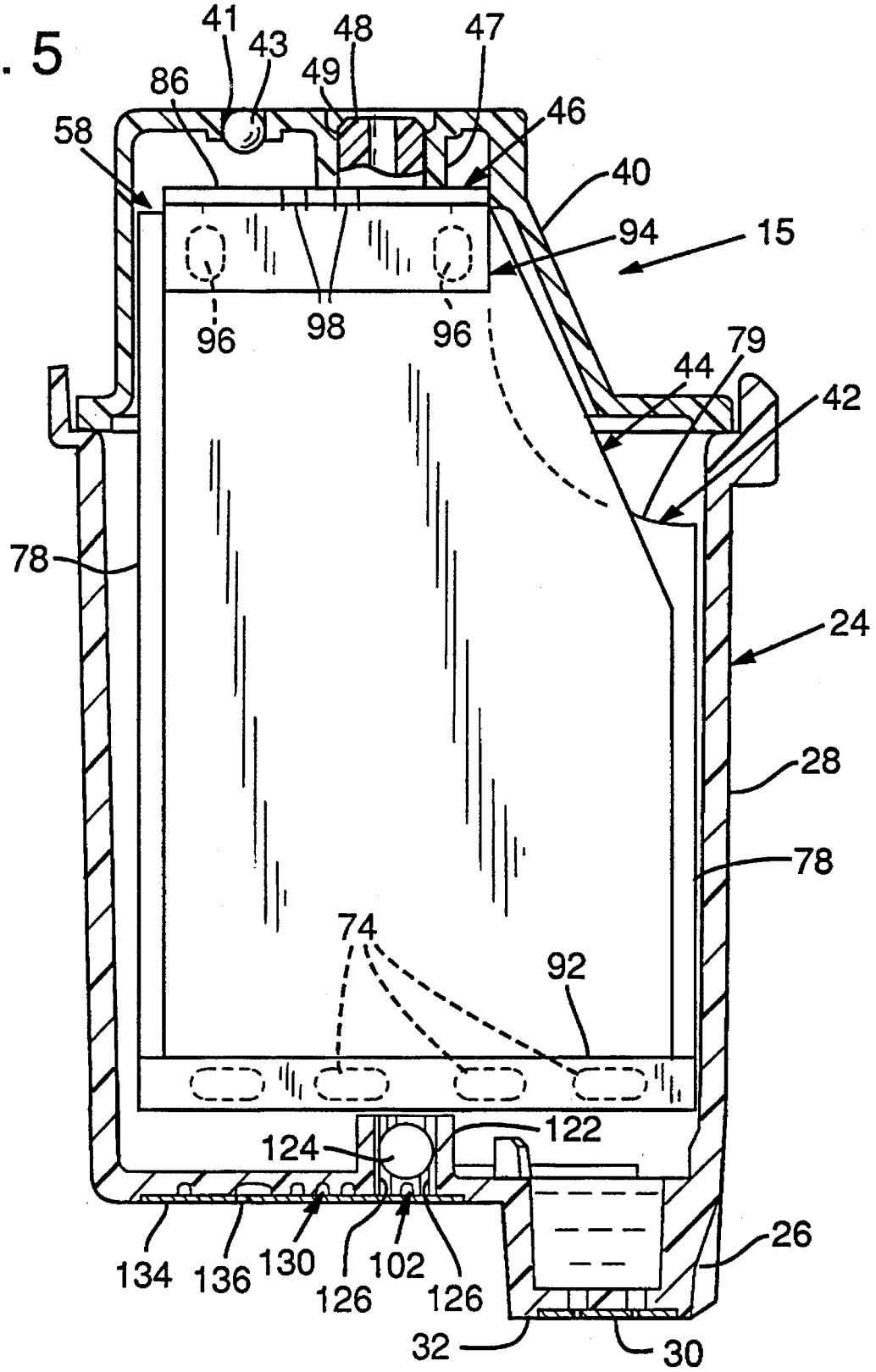
FIG. 5 is a cross-sectional view taken along the line 5—5 of FIG. 1.
Figure 6:
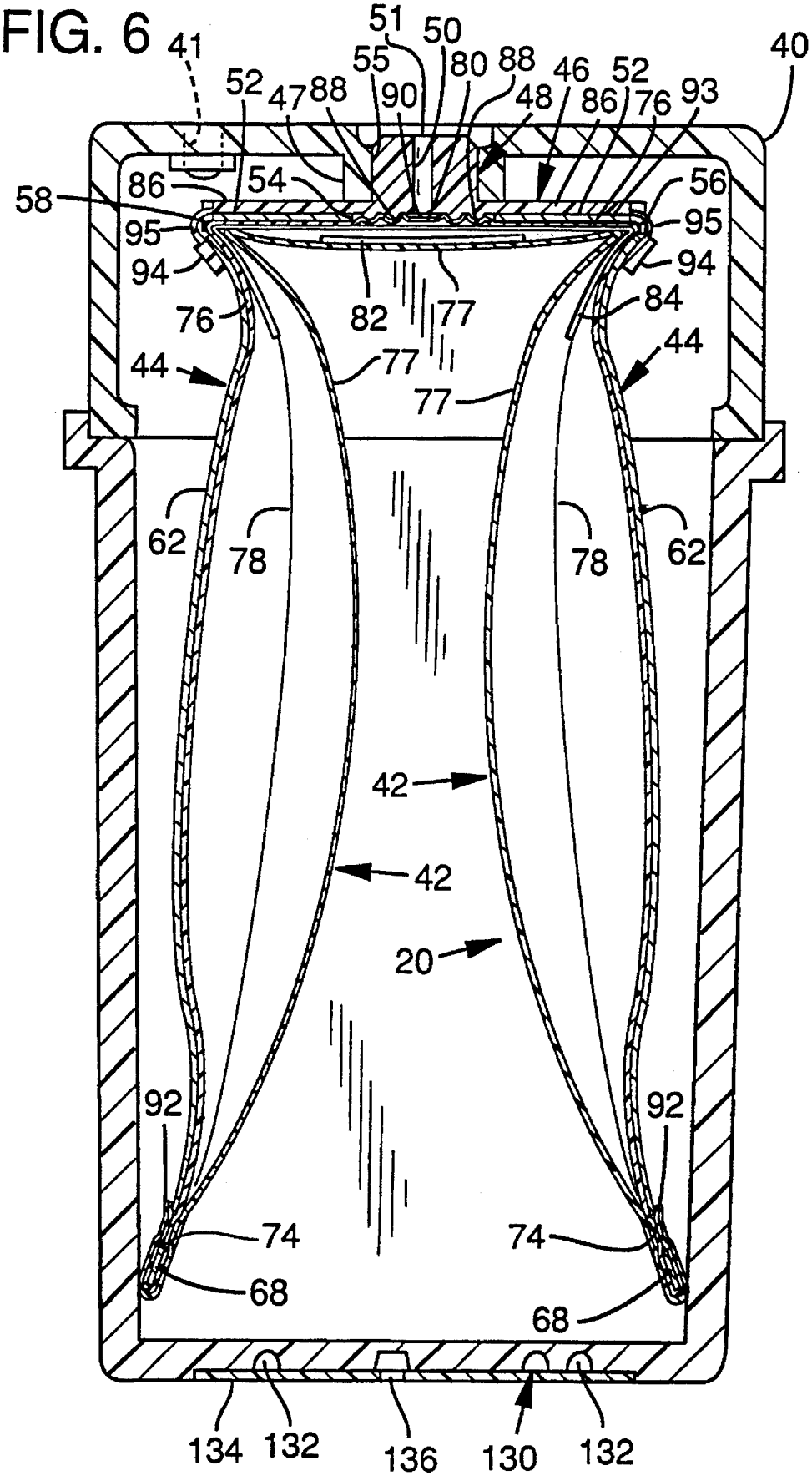
FIG. 6 is a sectional view, similar to FIG. 3, showing the expansion of an accumulator within the pen.

Turning now to the particulars of the accumulator 20 formed in accordance with the present invention, and with particular reference to FIGS. 3, 5 and 6, the preferred embodiment of the accumulator spring 44 comprises a strip of metal, such as stainless steel, having a thickness of approximately 75 microns (μ) and a yield strength greater than 5,600 $Kg/cm^2$. The spring 44 may be stamped or etched from a flat sheet and shaped into the relaxed or undeflected configuration shown in FIG. 3.

The relaxed configuration of the spring 44 includes a flat base 52 having a round main aperture 54 formed therethrough. The spring 44 is bent at each edge 56, 58 of the base 52. Elongated slots are formed in the spring 44 at each base edge 56, 58 to facilitate bending of the spring 44 at the base edges 56, 58.

The spring 44 is formed to have curved legs 62. One leg 62 extends downwardly from each edge 56, 58 of the base 52. Each spring leg 62 is formed to have a convex surface 64 facing inwardly toward the convex surface 64 of the other leg 62.

Four access holes 71 are formed in the spring base 52. One hole 71 is located near each corner of the base 52. A pair of spaced apart access holes 72 are formed through the spring legs 62 beneath and near each base edge 56, 58. Four other spaced apart access holes 74 are formed through the ends 68 of each spring leg 62. The access holes 71, 72, 74 provide means for attaching the bag 42 to the spring 44, as described more fully below.

The bag 42 of the present invention is preferably formed of two thin flexible sheets 76, 77 (FIG. 6) that are sealed together at their outer edges 78. One sheet, the first sheet 76, has an opening 80 for permitting the passage of air into and out of the space between the edge-sealed first sheet 76 and second sheet 77. The sheets 76, 77 are shaped slightly larger (i.e., in width and length) than the spring 44. Moreover, the portion 79 of the edge 78 of each sheet that is near the tapered part of the spring 44 is shaped into a smooth curve.

Preferably, the first and second sheets 76, 77 are formed of a material that can be heat-welded (as at the edges 78) and that is substantially impermeable to air. Heat-weldable bag material is preferred because such material permits an efficient method for forming the bag 42 and for attaching the bag 42 to the spring 44 and fitment 46, as will be described more fully below.

Material that is substantially impermeable to air is preferred as bag material so that the back pressure within the pen reservoir 24 is not reduced by air that passes into the bag 42 through opening 80 and then diffuses through the walls of the bag sheets 76, 77 into the reservoir 24.

In view of the above, a preferred embodiment of the sheets 76, 77 that make up the bag 42 comprises a thin "barrier" film of material such as ethylene vinyl alcohol (EVOH) covered with thin outer layers of polyethylene. The EVOH film is preferably about 12μ thick. The polyethylene layers are between 15μ and 50μ thick.

The EVOH film provides the desired low-air-permeability property. It is contemplated, however, that the barrier film for preventing diffusion of air through the bag 42 may be formed of a variety of materials such as PVDC (SARAN), nylon, polyester or metal foils, or combinations of such materials.

The polyethylene outer layers of the sheets 76, 77 provide the desired heat-weldable property. The use of polyethylene as outer bag layers is also advantageous because that material generally includes no cure accelerators or plasticizers that might leach into and thereby contaminate the ink within the reservoir 24, Before the bag 42 is formed by edge-welding the sheets 76, 77, two elements are placed between the sheets. One element, hereinafter referred to as a "release patch" 82, comprises a thin (approximately 25μ) sheet of material, such as polyester, having a melting point that is substantially higher than the melting point of the polyethylene outer layers of the bag sheets 76, 77. The release patch 82 is generally circular shaped and positioned beneath the opening 80 in the bag 42. Preferably, the release patch 82 includes an adhesive on one side for securing the patch 82 to the second sheet 77 of the bag 42. The release patch 82 provides a mechanism for facilitating attachment of the bag 42 to the fitment 46, as described more fully below.

The second element that is disposed within the bag 42 is a narrow strip, hereinafter referred to as a breather strip 84, of perforated polyethylene material having a maximum thickness of approximately 375μ, such as that manufactured by Ethyl VisQueen Film Products under the trademark VISPORE. The breather strip 84 provides a mechanism for facilitating movement of air into and out of the bag 42, as described more fully below.

The spring 44 and the bag 42 are attached to the underside of the fitment 46. More particularly, the fitment 46 is formed of polyethylene having a higher melting point than the polyethylene outer layers of the bag sheets 76, 77 and includes a generally flat base plate 86 having an upwardly projecting boss 48. The boss 48 is generally cylindrically shaped and has a chamfered upper end 49. The boss 48 includes the internal duct 50 that extends completely through the boss.

The fitment base plate 86 includes two concentric annular mounting rims 88 that are integrally formed with the base plate 86 to protrude downwardly therefrom through the main aperture 54 in the base 52 of the spring 44. The mounting rims 88, which surround the lower end 90 of the duct 50 are employed for fastening the bag 42 to the fitment 46. To this end, the portion of the first bag sheet 76 that surrounds the bag opening 80 is pressed through the main aperture 54 in the spring 44 to bear upon the mounting rims 88. A heated chuck (not shown) is pressed against the second sheet 77 of the bag 42 immediately beneath the mounting rims 88. Heat from the chuck is transferred from the second sheet 77 via the release patch 82 to the interface of the mounting rims 88 and the first sheet 76. The mounting rims 88, which, as part of the fitment are formed of polyethylene having a higher melting point than the bag, are heated to until the rims 88 and the first sheet 76 flow together to form a weld. Upon cooling, the rims 88 bond with the first layer 76 to form an air-tight seal.

With the bag 42 sealed to the fitment 46 as just described, the only path for air into and out of the bag 42 is through the duct 50 in the fitment boss 48.

It can be appreciated that the release patch 82, in addition to transferring heat from the chuck to the interface of the first sheet 76 and mounting rims 88, separates the first and second sheets 76, 77 in the region where the heated chuck is applied. Accordingly, the release patch 82 prevents the two bag sheets 76, 77 from becoming bonded together at the mounting rims 88.

Preferably, the outermost mounting rim 88 of the fitment 46 is sized to have a diameter that is just slightly less than the diameter of the main aperture 54 in the spring 44. Accordingly, the spring base 52 fits snugly around the outermost rim 88. The effect of this fit is to provide a registration mechanism for centering the spring aperture 54 beneath the duct 50 in the fitment 46. Moreover, the spring base 52 also includes an alignment hole (not shown) formed therethrough that mates with a downwardly projecting pin (not shown) in the fitment base plate 86. The mating alignment hole and pin provide a supplemental registration mechanism to ensure that the spring 44 is properly positioned relative to the fitment 46.

The bag 42 is fastened to the fitment 46 and spring 44 in a manner that urges the bag into a contracted or minimum volume state. The preferred means for fastening the bag 42 includes heat-welding the bag 42 to the fitment through the access holes 71, 72 at the base 52 of the spring 44, and securing each end 92 of the bag 42 to a corresponding end 68 of a spring leg 62.

More particularly, the underside of the fitment base plate 86 includes four downwardly extending posts, each of which fits through an aligned access hole 71 in the corner of the spring base 52. The posts pierce the bag sheets 76, 77 as a heated platen (not shown) is pressed against the bag sheets 76, 77. The platen then spreads and flattens the ends of the posts to effectively form a rivet to attach the bag sheets 76, 77 to the fitment base plate 86. This operation is performed while the bag 42 is substantially completely contracted.

Each of two opposing ends of the fitment base plate 86 is formed to have an extension 94 that is attached to the base plate 86 by two spaced apart hinges 95 (FIG. 6). The hinges 95 are thinner (approximately 250μ) than the base plate 86 and fold around the associated edges 56, 58 of the spring base 52 so that each extension 94 covers a pair of access holes 72 formed beneath and near each edge 56, 58. Each extension 94 includes on its underside an outwardly projecting pair of posts 96. Each of the posts 96 is sized and arranged to fit through an associated access hole 72. With the posts 96 extending through the access holes 72, both sheets 76, 77 of the bag 42 are pressed against the pairs of posts 96 at each edge 56, 58. The posts 96 are then heat-riveted to the contacting bag sheets 76, 77 in a manner as previously described.

The breather strip 84 within the bag 42 is aligned between adjacent access holes 72 in the spring and extends completely around each bent edge 56, 58 of the spring 44. Accordingly, the breather strip 84 facilitates air movement through the bag even though the bag is tightly fastened to the edges 56, 58 of the spring base 52 at the access holes 72. Moreover, the breather strip 84 ensures that the bag 42 will expand (i.e., the sheets 76, 77 will move apart) despite condensation within the bag, which condensation would tend to stick the sheets 76, 77 together.

The ends 92 of the bag 42 are wrapped around the ends 68 of the spring legs 62 so that each portion of the bag that is between the edges 56, 58 and the leg ends 68 is pulled firmly against the convex surface 64 of each leg 62 (FIG. 3). The ends 92 of the bag 42 cover the access holes 74 in the leg ends so that when heat is applied to the bag 42 at the access holes 74, the bag 42 will weld to itself within the holes 74 to secure the bag ends 92 to the spring leg ends 68.

The periphery 55 of the fitment boss 48 is sealed to the sleeve 47 in the reservoir cap 40 so that no air can pass between the fitment 46 and the cap 40. The cap 40 is then sealed to the reservoir side walls with the accumulator 20 suspended inside the reservoir 24. The reservoir 24 is then filled with ink, as described earlier.

As noted earlier, the filled pen 22 is provided with a minimum back pressure. Calculated at the print head 30, the minimum back pressure should be, for example, 2.5 cm water column. Accordingly, the minimum back pressure is established by removing some ink from the filled and sealed reservoir.

The minimum back pressure level establishes the low end of the back pressure operating range referred to above. The maximum back pressure or upper level of the back pressure operating range is that level (for example, 11.5 cm water column) above which the print head 30 would be unable to "pump" against for ejecting ink drops.

As the print head 30 operates to eject ink drops from the reservoir 24, the consequent reduction in ink volume in the reservoir increases the back pressure. If this increase were not regulated, the back pressure in the reservoir 24 would rapidly increase beyond the maximum back pressure, and the print head 30 would become inoperative. With the present accumulator 20, however, the back pressure increase above the minimum level tends to expand the bag 42. More particularly, as the back pressure increases, the relatively higher-pressure ambient air is drawn through the duct 50 in the fitment 46 and into the opening 80 in the bag 42. As the bag 42 expands, the first sheet 76 of the bag presses against the spring legs 62 so that those legs 62 are deflected out of the relaxed, curved configuration (FIG. 3) into a reverse bowed configuration (FIG. 6).

The elasticity of the spring legs 62, which tends to contract the bag 42 against the convex surfaces 64, is substantially overcome by the expansion of the bag 42 that is caused by the increase (over minimum) of the back pressure within the reservoir 24. The volume decrease in the reservoir 24 that is attributable to the expansion of the bag 42 maintains the back pressure beneath the maximum back pressure discussed above.

The bag 42 expands to its maximum volume condition as ink is printed out of the pen. During this expansion, the bag 42 maintains the back pressure beneath the maximum back pressure level. At the point when the bag 42 of the preferred embodiment has expanded to its maximum volume condition, about 30% of the pen's ink has been printed out. Any further printing will cause a further increase in back pressure, which is relieved by the introduction of ambient air into the reservoir 24. To this end, the pen 15 includes a bubble generator 102 formed in the bottom wall 38 of the reservoir 24.

The bubble generator 102 (FIG. 5) consists of a tubular boss 122 and a sphere 124 mounted concentrically within the boss. The outside diameter of the sphere 124 is smaller than the inside diameter of the boss 122 to define an annular orifice 120 (seen in FIG. 4). In the illustrated embodiment, the sphere is maintained within the boss by a number of raised ribs 126 formed around the interior of the boss. In this manner the sphere 124 can be easily press fit into the boss 122 and firmly maintained in position by the ribs 126. The raised ribs 126 are sized to provide the necessary interference for a press fit to maintain the sphere within the boss and provide the necessary clearance from the inside wall of the boss.

The sphere 124 serves as a capillary member to maintain a quantity of ink within the boss 122. As a results even when the pen is oriented such that the boss is not submerged in the reservoir ink, a quantity of ink is trapped within the boss. Due to the curved surface of the sphere, the gap between the exterior surface of the sphere and the inner wall of the boss is smallest at the orifice and increases as the distance from the orifice increases. This geometry, coupled with the capillarity of the ink, constantly urges the trapped quantity of ink toward the orifice—the smallest portion of the gap—to provide a robust seal.

Figure 4:
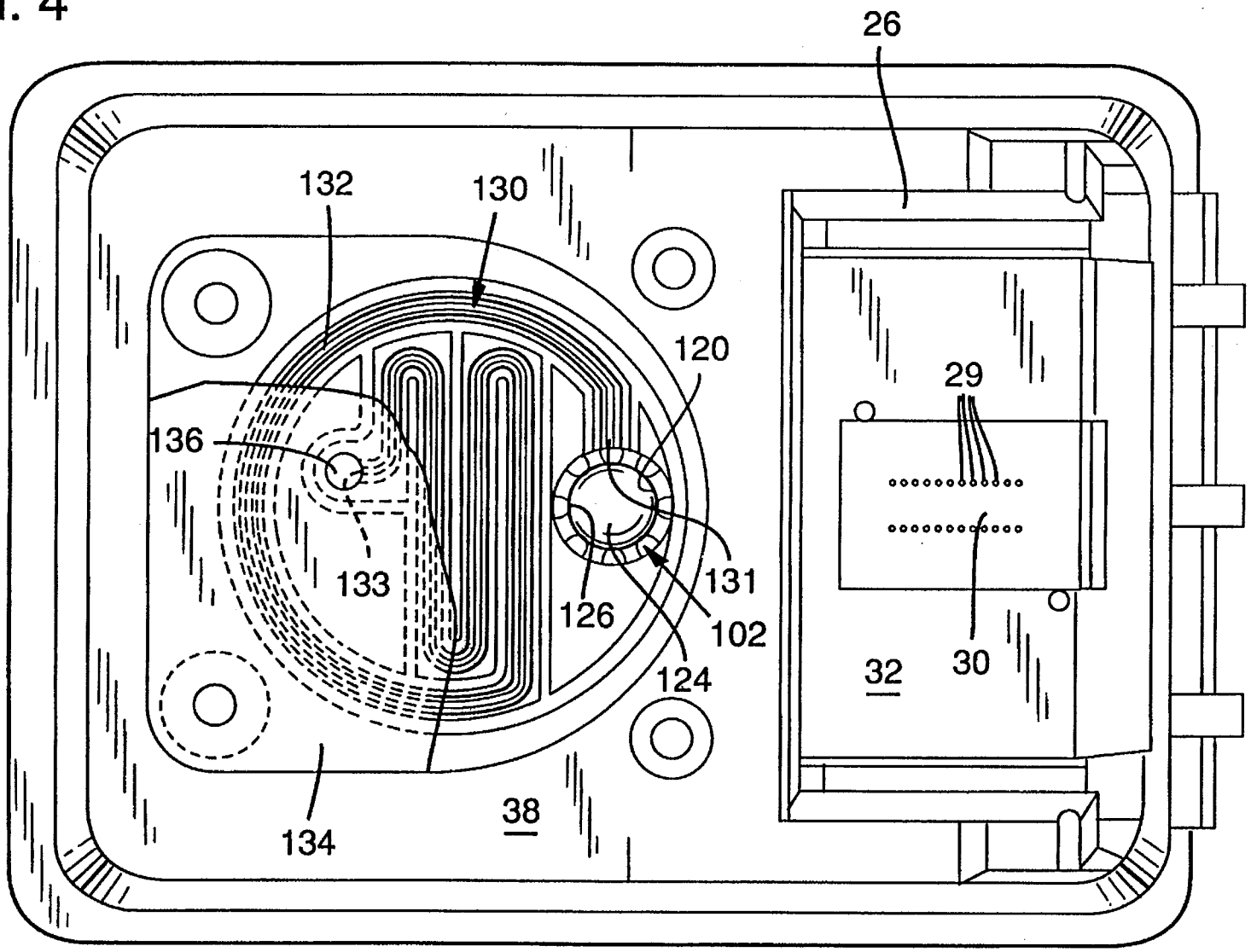
FIG. 4 is a bottom view of the pen of FIG. 1.

To prevent the trapped quantity of ink from drying or solidifying as a result of prolonged exposure to the atmosphere, the bubble generator is provided with an inlet labyrinth 130 which serves as a vapor barrier. The inlet labyrinth, best seen in FIGS. 4 and 5, is a path through which the ambient air must travel before contacting the trapped ink. The proximal end 131 of the labyrinth opens to the boss 122 and the distal end 133 opens to ambient air. The length of the labyrinth is sealed from both the ambient and the reservoir. As a result, the humidity within the labyrinth varies along its length from approximately 100% at the proximal end 131 to approximately ambient at the distal end 133. This humidity gradient serves to shield the trapped ink from direct contact with ambient air and prevent the trapped ink from drying or solidifying.

The inlet labyrinth is a path having a semicircular cross section. The ratio of the cross sectional area to length of the inlet labyrinth should be such that the volume of air in the inlet labyrinth effectively blocks convective mass transfer. Diffusive vapor losses are driven by the partial pressure gradients through the inlet labyrinth. As indicated by Fick's Laws of Diffusion, these losses are proportional to the cross sectional area of the inlet labyrinth and inversely proportional to the length of the inlet labyrinth. The appropriate dimensions of an inlet labyrinth for any particular embodiment can be empirically determined by one skilled in the art.

As best seen in FIGS. 3 and 4, the inlet labyrinth 130 in the illustrated embodiment, is a trough 132 molded directly into the external surface of the pen wall 38. A cover 134 is attached to the reservoir to seal the trough 132 between its ends. A hole 136 through the cover at the distal end 133 of the trough 132 provides fluid communication between the trough (and the bubble generator) and is an inlet for the ambient atmosphere. The circuitous configuration of the trough conserves space and reduces the size of the cover.

The inlet labyrinth 130 also serves as an overflow receptacle. If the pen is subject to an environmental change, such as a temperature or altitude variation, which causes the fluid volume within the reservoir to expand beyond the capacity of the reservoir, the excess ink can exit the reservoir via the bubble generator and enter the inlet labyrinth 130. Subsequently, when the environmental conditions return to normal, or ink is depleted from the reservoir, the excess ink can reenter the reservoir.

To ensure that excess ink in the labyrinth will completely reenter the reservoir, it is preferable that the largest cross-sectional dimension of the labyrinth is small enough to allow the ink to form a complete meniscus across the cross section at any location along the labyrinth. Otherwise, small amounts or beads of ink may become stranded in the labyrinth. In the illustrated embodiment, the maximum cross-sectional dimension of the labyrinth is approximately 0.89 mm.

The effectiveness of the illustrated ink-jet pen depends on the appropriate sizing of the orifice 120, the boss 122, and the sphere 124 to ensure that the liquid seal gives way below the maximum allowable back pressure and is reinstated above the minimum allowable back pressure. The exact dimensions of the various elements of the ink pen will depend on a number of factors, such as the surface energies of the materials, the density and surface tension of the ink, the desired range of back pressures, and the shape of the orifice. Once these factors are known, the proper dimensions can be readily calculated or empirically determined by one skilled in the art.

If, for example, the desired range of back pressures is from 10 cm to 16 cm water column and the ink used has a density of approximately 1 g/cm$^3$ and a surface tension of approximately 60.2 dynes/cm stainless steel sphere having a diameter of approximately 3.18 mm and a polysulfone boss having an inside diameter of between 3.34 mm and 3.39 mm will be satisfactory. Of course, each particular embodiment of the invention may require different dimensions according to its particular parameters.

In accordance with the method of the present invention, the pen having the accumulator 20 and bubble generator 102 as just described may be refilled once depleted. The method is carried out so that a sufficient amount of back pressure remains in, or is reestablished in, the reservoir after refilling.

A first preferred approach to refilling or adding ink to a partly depleted reservoir 24 includes the step of occluding the fluid communication between the interior of the accumulator bag 42 with ambient air by blocking the upper end 51 of the duct 50. Any of a number of mechanisms can be employed for this occluding step. For instance, a piece of vinyl-backed adhesive tape may be pressed over the upper end of the duct 50. Alternatively, the plugged tip of a syringe may be inserted into the duct. Any member sized for providing a substantially air-impermeable occlusion of the duct 50 during the refilling operation may be used.

Once the fluid communication between the accumulator bag interior and ambient air is occluded, the spherical plug 43 is removed from its port 41 to open the reservoir for the purpose of adding ink. The plug 43 may be pried out by the use of a stylus or scribe. Alternatively, the plug may be forced out of its port 41 and into the reservoir by the use of a punch or similar mechanism. Prying out the plug 43 will preserve it for use in resealing or closing the reservoir after the filling operation. Punching the plug into the reservoir will require replacement with a new plug (or other suitable mechanism) for closing the reservoir port 41 once the filling operation is completed.

It will be appreciated by one of ordinary skill that once the reservoir is open via the removal of the plug 43, back pressure within the reservoir is lost, but restored once the pen is refilled, as described more fully below.

Figure 7:
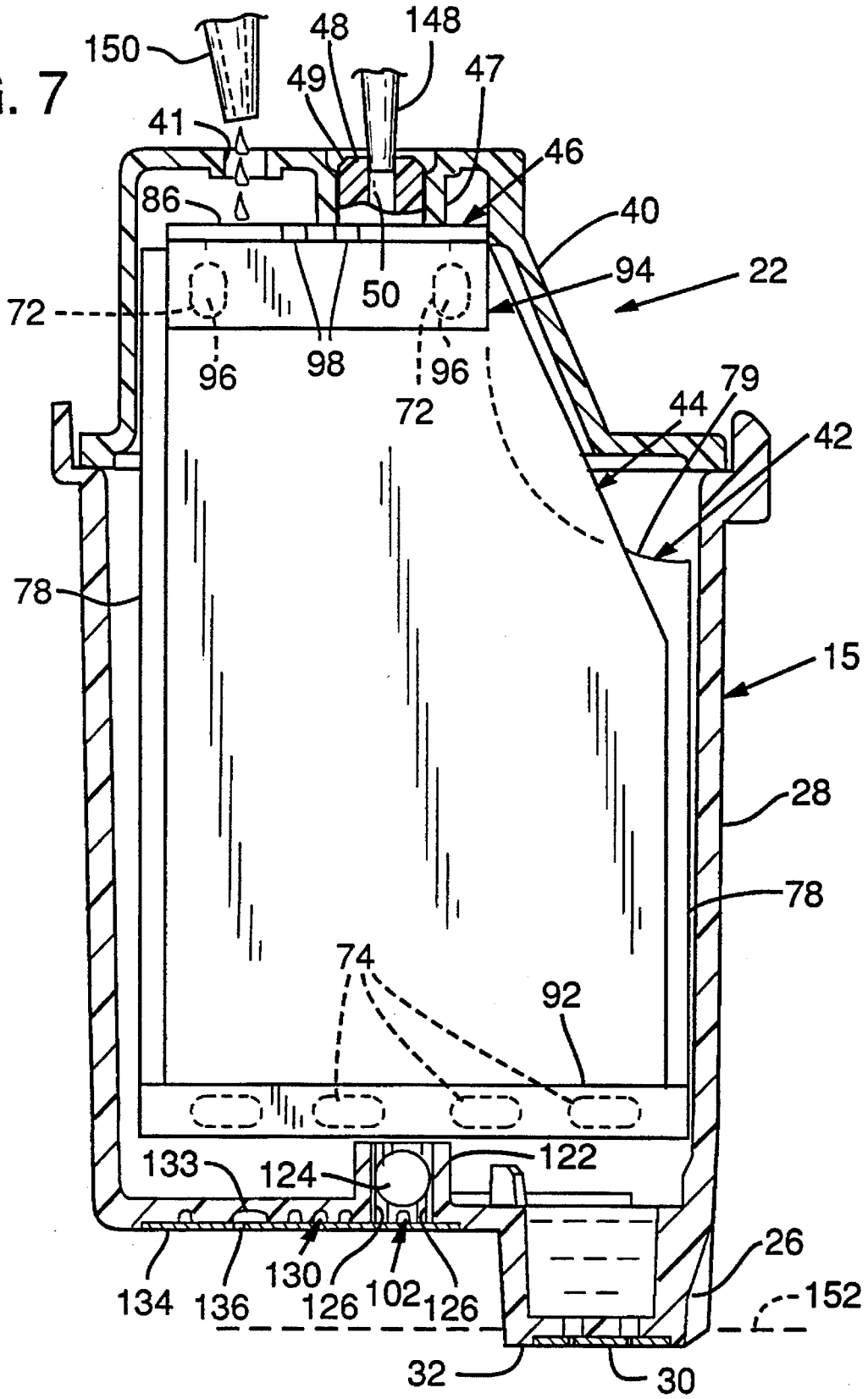

FIG. 7 depicts the filling operation, wherein the plugged tip of a syringe 148 was first inserted into the duct 50; the spherical plug 43 (not shown) was removed as described above; and ink is delivered through the port 41 to the open reservoir via a suitable conduit 150 from an external supply.

As a result of the loss of back pressure attendant with opening the reservoir for filling, ink will tend to leak from the print head nozzles 29 while the refilling operation takes place. To prevent this leaking or drooling, it is desirable to block the fluid communication between ambient air and the interior of the reservoir that is provided by the nozzles. This block may be achieved by covering the print head 30 with a vinyl-backed tape, or the like, for the purpose of covering the nozzles 29 of the print head before the reservoir is opened. It is contemplated that any one of a number of techniques can be employed for blocking or otherwise sealing the print head nozzles during the refill operation. Alternatively, such leaking through the nozzles 29 may be permitted, with residual ink being wiped from the print head upon completion of the refilling operation.

A loss of back pressure within the reservoir 24 during the refilling operation (that is, when the reservoir is open as a result of removal of the plug 43) will also permit ink to flow out of the reservoir through the bubble generator 102, through the inlet labyrinth 130 to leak from the hole 136 at the distal and 133 of the labyrinth. While such leakage may be permitted during the refilling operation (and residual ink wiped away upon completion of the refilling operation), it is preferred to block the fluid communication between ambient air and the interior of the reservoir that is provided by the bubble generator orifice 120 and its contiguous inlet labyrinth. A preferred method for blocking this fluid communication is to apply air-impermeable tape (such as the vinyl-backed tape mentioned above) to the cover 134 for the purpose of occluding the hole 136 in the cover. It is contemplated that any one of a number of techniques can be employed for occluding or otherwise sealing the hole in the cover.

Once the desired amount of ink is added to the reservoir 24, the reservoir is closed, for example, by pressing a spherical plug 43 back into the port 41. Any of a number of mechanisms may be employed for closing the reservoir. For example, a compliant plug made of wax may be used to seal the port 41. Such a plug may be easily removed and reused during subsequent refill operations. A complaint plug, such as beeswax, conforms to the shape of the fill port 41 to provide a robust seal.

A plug formed of compliant, elastic material is also contemplated for sealing the port (hence, closing the reservoir). Moreover, a foam-backed, self-adhesive tape may be used, firmly applied to the cap 40 to span and seal the port 41. Also, self-tapping set screw may be threaded into the port 41 for use as a replacement plug.

Alternatively, the plug 43 may be replaced (during, for example, the first re-fill operation) with a permanently attached conduit, having one end fit into the port 41. The other end of the conduit may be detachably connected to an ink supply. A small valve or petcock is connected to the conduit and is openable for permitting ink to flow from the supply through the conduit, and closeable for closing the conduit (hence, closing the reservoir).

Upon closure of the reservoir, fluid communication between the interior of the accumulator bag and ambient air is restored as a result of the removal of the plugged syringe tip 148. Removal of the syringe tip permits air to flow out of the accumulator bag as the bag is contracted by the spring 44. In view of the accumulator configuration described above, the contraction of the bag provides an increase in reservoir volume by an amount sufficient to reestablish a minimum back pressure within the reservoir 24. In this regard, is noteworthy that whenever it is necessary to add ink to the reservoir, the bag 42 will be in a partly to near-completely expanded state (depending upon how much ink has been depleted as explained above), and held in that state during the refilling process as a result of occluding the duct 50.

An alternative method to refilling the pen begins with the step of opening the pen by removing the plug 43 as mentioned above. This opening step can be preceded by the steps of covering the print head nozzles 29 and blocking the cover hole 136 to avoid leakage, as described above. With this alternative approach, however, the duct 50 leading to the interior of the accumulator bag 42 is not occluded before the pen reservoir is opened. As a result, the loss of back pressure within the reservoir eliminates resistance to bag contraction, thereby permitting the spring 44 to completely contract the accumulator bag.

Next, ink is added to the reservoir, such as through the conduit 150 mentioned above. Because the accumulator bag 142 is to be inflated after ink is added, as described below, it is important that the maximum amount of ink that can be stored in the reservoir is not added during the refilling process because the subsequent expansion of the bag would have the effect of pumping excess ink out of the print head or bubble generator orifice. Accordingly, it is preferred that the amount of ink added is no greater than the maximum quantity that can be stored in the reservoir, minus the maximum expanded volume of the accumulator.

After the desired amount of ink is added to the pen reservoir, the back pressure is reestablished. To this end, the accumulator bag is expanded to establish the minimum back pressure. A number of methods may be employed for expanding the bag. For example, pressurized air may be directed through the duct 50 to the interior of the bag. Air can be directed in this manner by a conventional syringe (like syringe 148 but without a plugged tip) that has a tip exterior shaped to fit snugly into the duct so that the accumulator bags can be forced open via the air pressure delivered from the syringe without air leakage between the duct 50 and the exterior of the syringe tip.

Preferably, a controlled amount of air (for example 6.0 cubic centimeters at ambient pressure) is delivered to the accumulator bag interior. A controlled amount is important for preventing bursting of the bag.

With the accumulator bag fully expanded or inflated, the reservoir is closed by the replacement of the plug 43, or by any other suitable mechanism for sealing the port 41. Thereafter, the syringe tip used for inflating the accumulator is removed to permit air to flow out of the accumulator bag, the resulting contraction of the bag, as before, establishing a minimum back pressure in the reservoir.

As an alternative method for reestablishing back pressure in the reservoir after ink has been added, a small volume of ink may be drawn from the reservoir through the print head after the reservoir is closed (while the accumulator bag remains in fluid communication with ambient air). For example, the print head may be temporarily placed in contact with highly absorbent paper or cloth having sufficient capillarity for drawing ink through the nozzles. A small volume of ink may be otherwise removed, such as by printing with the pen for a brief period of time, or by applying a sufficient amount of suction to the exterior of the print head.

Figure 8:
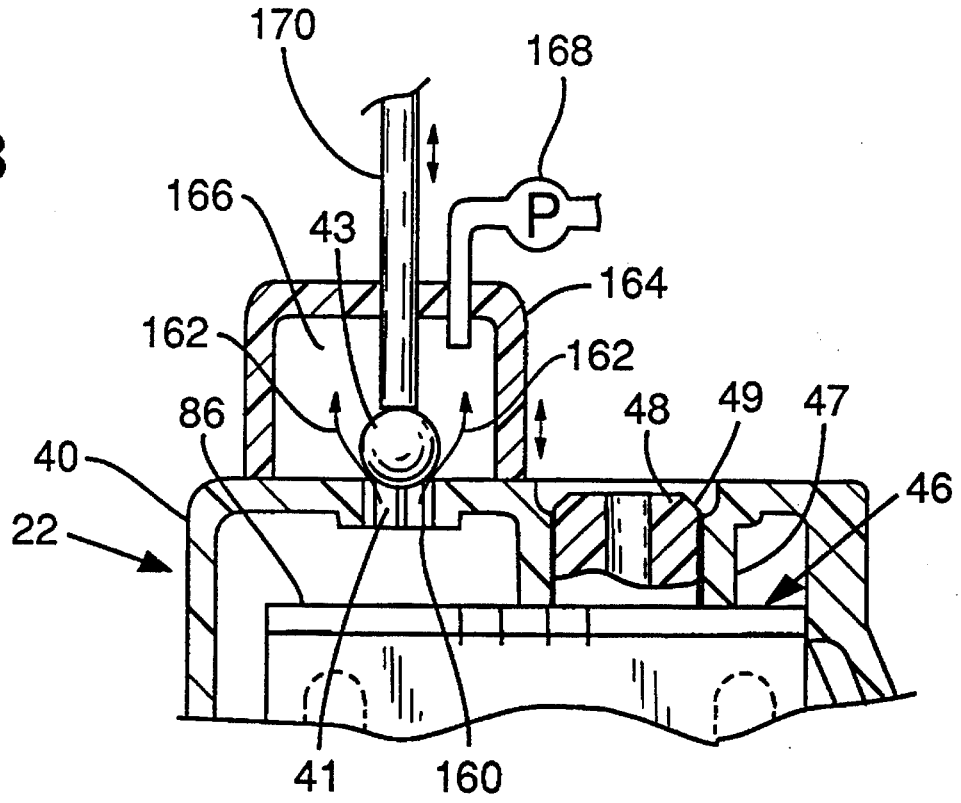
FIG. 8 is an enlarged sectional view of the print cartridge illustrating alternative steps of the method of the present invention.

Another alternative method for reestablishing back pressure within the reservoir after ink has been added is illustrated in FIG. 8. FIG. 8 depicts the top portion of a print cartridge just after the preferred amount of ink has been added to the reservoir. The accumulator duct 50 remains open, in communication with ambient air. Preferably, hole 136 and the print head nozzles have been blocked.

For the purpose of carrying out the method depicted in FIG. 8, the port 41 is configured to include spaced apart inwardly projecting ridges 160 on top of which the plug 43 may rest as shown in FIG. 8. With the plug in this position, a passage for air, shown by arrows 162 extends from the interior of the reservoir to outside of the cap 40 of the print cartridge. A member serving as an inverted suction cup 164 is then moved downwardly against the top of the filled pen to surround the port 41 and define a substantially enclosed chamber 166. The chamber 166 is then partially evacuated via, for example, a positive displacement pump 168 that removes a sufficient volume (for example 6.0 cc) of fluid comprising air, or ink, or a combination of air and ink, from the chamber 166, hence from the reservoir interior, for establishing the minimum back pressure within the print cartridge. With the back pressure so established, a plunger 170 moves against the plug 43 to force the plug into sealing position within the port 41. The vacuum and sealing components 164, 168, 170 are thereafter removed.

The just-described ridges 160 are not necessary and, in the alternative, the plug 43 may rest on the top edge of a cylindrically-shaped port and be lifted slightly (as the chamber 166 is partially evacuated) from the port to provide the fluid passage from the reservoir interior.

The tape or other mechanism employed for blocking the hole 136 and covering the print nozzles 29 is removed prior to operation of the refilled pen.

As noted above, as nearly all of the ink is depleted from the reservoir the back pressure within the reservoir reaches the upper operational limit. In such a state, it is possible to employ another alternative method for adding ink to the pen reservoir by immersing the nozzles 29 of the print head in a supply of ink. The dashed line 152 appearing in FIG. 7 is intended to illustrate the upper surface of the ink supply just mentioned. With the nozzles so immersed, the reservoir closed, and the accumulator bag maintaining fluid communication with ambient air, the high back pressure within the reservoir is sufficient for drawing through the nozzles and into the reservoir a substantial quantity of ink.

The back pressure level within the reservoir will gradually decrease until reduced back pressure is insufficient for drawing additional ink through the nozzles. At that point in time, the immersed print head is removed from the external ink supply. The pen should be quickly wiped off and replaced in the printer.

While having described and illustrated the principles of the invention with reference to preferred embodiments and alternatives, it should be apparent that the invention can be further modified in arrangement and detail without departing from such principles. Accordingly, it is understood that the present invention includes all such modifications that come within the terms of the following claims and equivalents thereof.

The invention claimed is:

1. A method of adding ink to a reservoir defined within a print cartridge that has a print head for selectively ejecting ink through nozzles in the print head, wherein the cartridge has a movable accumulator that is contained within the reservoir the accumulator having walls that define a volume that is in fluid communication with ambient air through a duct formed in the cartridge, comprising the steps of:

occluding the fluid communication between the accumulator volume and ambient air;

adding ink to the reservoir; and restoring the fluid communication between the accumulator volume and ambient air.

2. The method of claim 1 further including the step of sealing the nozzles of the print head before adding the ink.

3. The method of claim 1 wherein the adding step occurs after the occluding step and comprises the substeps of opening the reservoir to receive ink; adding the ink; and closing the reservoir.

4. The method of claim 1 wherein the adding step includes attaching to the print cartridge a removable plug member for opening and closing the reservoir.

5. A method of adding ink to a reservoir defined within a print cartridge that has a print head for selectively ejecting ink through nozzles in the print head, wherein the cartridge has a movable accumulator contained within the reservoir, the accumulator having walls defining a volume that is in fluid communication with ambient air through a duct formed in the cartridge, and wherein an orifice is formed in the cartridge to provide fluid communication between ambient air and the reservoir, comprising the step of:

occluding the fluid communication between the accumulator volume and ambient air;

blocking the fluid communication provided by the orifice;

adding ink to the reservoir;

restoring the fluid communication between the accumulator and ambient air; and restoring the fluid communication provided by the orifice.

6. The method of claim 5 further including the steps of sealing the nozzles of the print head before adding the ink.

7. The method of claim 5 wherein the adding step occurs after the occluding step and comprises the substeps of opening the reservoir to receive ink; adding the ink; and closing the reservoir.

8. A method of adding ink to a reservoir of a print cartridge that has a print head for selectively ejecting ink through nozzles in the print head, wherein the cartridge has an accumulator that comprises an expandable bag that is contained within the reservoir and has an exterior and an interior volume that is air-filled and in continuous fluid communication with ambient air, comprising the steps of:

adding ink to the reservoir to fill the reservoir so that at least part of the bag exterior is immersed in ink;

establishing within the reservoir a back pressure for preventing ink from leaking through the nozzles; and sealing the reservoir.

9. The method of claim 8 wherein the establishing step comprises removing ink from the filled and sealed reservoir by drawing the ink through the nozzles.

* * * * *